US005842894A

United States Patent [19]

Mehlberg

[11] Patent Number: 5,842,894

[45] Date of Patent: Dec. 1, 1998

[54] CABLE LUG WITH FIXING ELEMENT

[75] Inventor: Reinhard Mehlberg, Herscheid, Germany

[73] Assignee: Nedschroef Plettenberg GmbH, Plettenberg, Germany

[21] Appl. No.: 863,720

[22] Filed: May 27, 1997

Related U.S. Application Data

[63] Continuation of Ser. No. 505,093, Jul. 21, 1995, abandoned.

[30] Foreign Application Priority Data

Jul. 28, 1994 [DE] Germany ..... 94 12 215 U

[51] Int. Cl.[6] ..... H01R 4/30

[52] U.S. Cl. ..... 439/801; 439/883; 439/433; 411/533; 411/999

[58] Field of Search ..... 439/801, 868, 439/883, 433; 411/368, 369, 533, 999

[56] References Cited

U.S. PATENT DOCUMENTS

| | | | |
|---|---|---|---|
| 1,874,593 | 8/1932 | Olson | 439/883 |
| 3,505,636 | 4/1970 | McDowell | 411/533 |
| 4,049,335 | 9/1977 | Julian | 439/868 |
| 4,717,299 | 1/1988 | Underwood | 411/533 |
| 4,969,788 | 11/1990 | Goiny | 411/533 |
| 4,971,498 | 11/1990 | Goforthe | 411/533 |
| 4,979,857 | 12/1990 | Wing | 411/533 |
| 5,470,183 | 11/1995 | Swick | 411/533 |
| 5,487,685 | 1/1996 | Stillback et al. | 439/801 |

FOREIGN PATENT DOCUMENTS

| | | | |
|---|---|---|---|
| 0248443 | 5/1963 | Australia | 439/883 |
| 1116764 | 11/1961 | Germany | 439/883 |
| 2138529 | 10/1984 | United Kingdom | 411/533 |

*Primary Examiner*—Neil Abrams
*Assistant Examiner*—T C Patel
*Attorney, Agent, or Firm*—Evenson, McKeown, Edwards & Lenahan, PLLC

[57] ABSTRACT

A fixing element has a screwthread for fixing to a main member. The fixing element includes a cable lug and a contact plate defined on the cable lug. The contact plate is completely rotatable around a longitudinal axis of the fixing element but is not removable from the fixing element.

14 Claims, 4 Drawing Sheets

CABLE LUG WITH FIXING ELEMENT

This is a continuation of application Ser. No. 08/505,093, filed Jul. 21, 1995, abandoned.

The invention concerns screwable fixing elements such as screws or nuts, by means of which releasable electrical connections are also made, in that a cable lug or terminal which in turn is connected to an electrically conductive cable is brought by means of said fixing elements into close electrically conductive contact with another metal article.

That procedure is used not only for circuit elements in the heavy-current area but for example also in the motor vehicle industry where, because of the supply using direct current, the bodywork of the vehicle forms the negative terminal of the circuit, and thus a large number of cables must be electrically conductively connected to the vehicle bodywork.

In that respect it is known for the cable lug or terminal which is non-releasably fixed to the cable and the contact plate of which has a bore either to be fitted over the screwthreaded stud which fixedly projects out of the bodywork and secured by a nut, or for a screw to be fitted through the bore in the contact plate, and for the screw to be screwed with its screwthreaded portion into a suitable female screwthread in the bodywork or fitted through a further bore in the bodywork, and secured by means of a nut on the rear side of the sheet metal of the bodywork.

In that situation there is the problem that the assembly personnel are always required to use one hand to grip the cable lug or terminal, while the other hand is used to hold the necessary fixing element, that is to say the screw or the nut, and in that way a third hand is frequently required to be able to position further parts or hold them fast in place.

In addition there is the danger that, out of the supply of screws and nuts at the assembly location, the assembly operator may take the wrong one and thus assembly is for the time being not possible in that situation, or, because the screw etc is of the wrong length, the arrangement does not afford a sufficiently reliable electrical contact in spite of mechanically adequate fixing of the cable lug. Both aspects together result in increased assembly times or finishing and rectification times.

It is also known that the fixing element, that is to say the screw or nut, is connected to the cable lug by the screw or nut being of a particular shape, and by the sheet metal tongues of the cable lug being bent over from the outside of the contact plate of the cable lug, around the nut or the head of the screw.

However that construction requires special design configurations in respect of the nuts or screws as well as a weakening of the cable lug by virtue of the tongues formed thereon, and thus impairment of the transmission of current through the cable lug. Furthermore this design configuration requires a relatively great structural height.

In order to reduce the assembly time and susceptibility to defects of motor vehicles, the object of the present invention is so to design the individual parts involved as to ensure faster and more error-free fitment of the cable lug and thus the electrical connection.

That object is attained in that the nut or screw is non-releasably and thus non-losably connected to the contact plate of the cable lug. Only rotary movement of the screw or nut relative to the contact plate, as is necessary for the screwing operation, is possible.

Because the nut or screw is fixed to the contact plate of the cable lug in such a way as to permit rotary movement, by means of a coaxially peripherally extending groove in the one component and projections engaging into the groove on the other component, it is possible to use screws or nuts of the normal configurations. In that way, the structural height of the arrangement is also not increased in comparison with the use of conventional, individual screws or nuts. Likewise, the transmission of current that the cable shoe has to afford is also not reduced by the tongues.

If the fixing element is a screw, this non-releasable but rotatable connection between the cable lug and the screw is achieved in a simple fashion for example by the contact plate of the cable lug being rotatably mounted with its bore on the outside diameter of a shank region 14 which is disposed between the head and the screwthreaded region of the screw, wherein the bore in the contact plate is of smaller diameter than the outside diameter of the screwthreaded region and also the head of the screw.

In manufacture, this can be achieved by the contact plate being pushed on to the shank region of the screw before the external screwthread of the screw is produced in the screwthreaded region by means of thread rolling, whereby it is only the outside diameter in the screwthreaded region that is increased to such a great degree that it is larger than the inner region of the bore in the contact plate.

Another option in terms of the connection, as can be selected for example when the fixing element used is in the form of a nut, provides that the nut or also the head of a screw has, adjoining the face directed towards the main member, a mounting region which is of greatly reduced outside diameter in comparison with the outside diameter of the screw or nut.

That affords a stepped configuration, and the contact plate of the cable lug is mounted rotatably but non-releasably in the stepped configuration, for example on the reduced outside diameter, with the inwardly directed peripheral surfaces of the bore, insofar as the one element has a groove extending around same in an annular configuration while the other element has an annular bead or ridge which extends around it and which engages into said groove, or a plurality of individual projections which are distributed around the periphery of said other element and which project into the groove.

In that respect it is important that the axial dimensioning is so selected that the axial length of the stepped configuration, with the reduced diameter of the nut or the head of the screw, is at a maximum as large as and is preferably somewhat smaller than the thickness of the contact plate. That ensures that, after the nut or the screw has been screwed into position, the nut or the head of the screw presses against the contact plate of the cable lug and it is exclusively the contact plate of the cable lug that bears against the main member, but not the nut itself, with its face which is directed towards the main member, in the region of the reduced diameter.

An adequate mounting effect can also be provided in the region of the inside periphery of the through bore in the nut, into which a suitable flange region of the contact plate would have to project, in which case the inside diameter in the nut would then have to be larger than the internal screwthread of the nut, and that mounting arrangement would also have to be disposed adjoining the contact end face of the nut.

Embodiments according to the invention are described in greater detail by way of example hereinafter with reference to the drawings in which.

Figure 1:
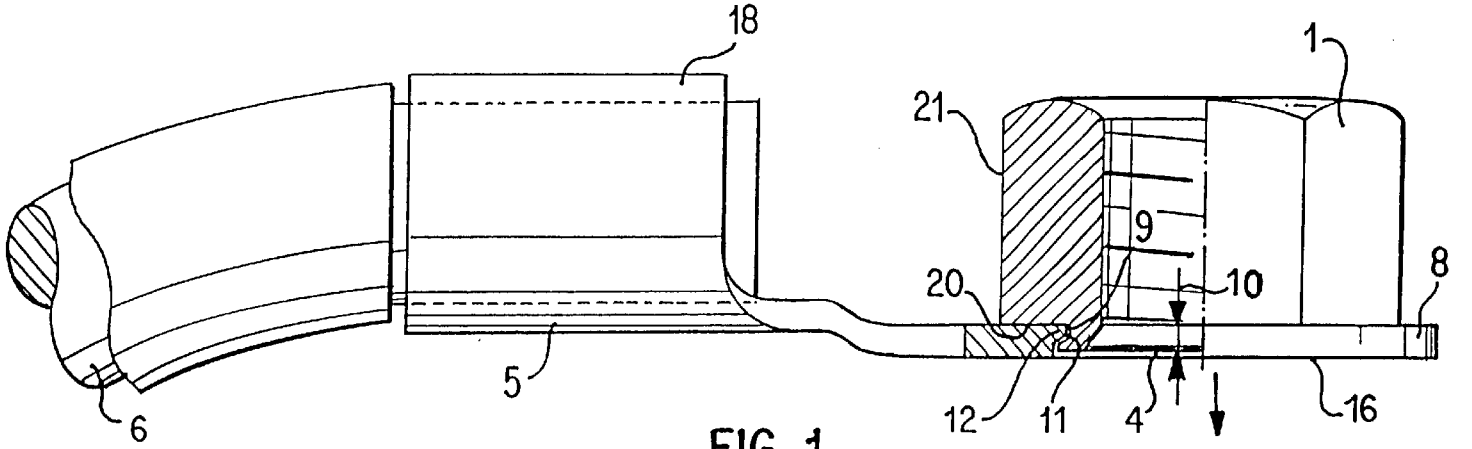
FIG. 1 is a side view of a nut with cable lug.
Figure 2:
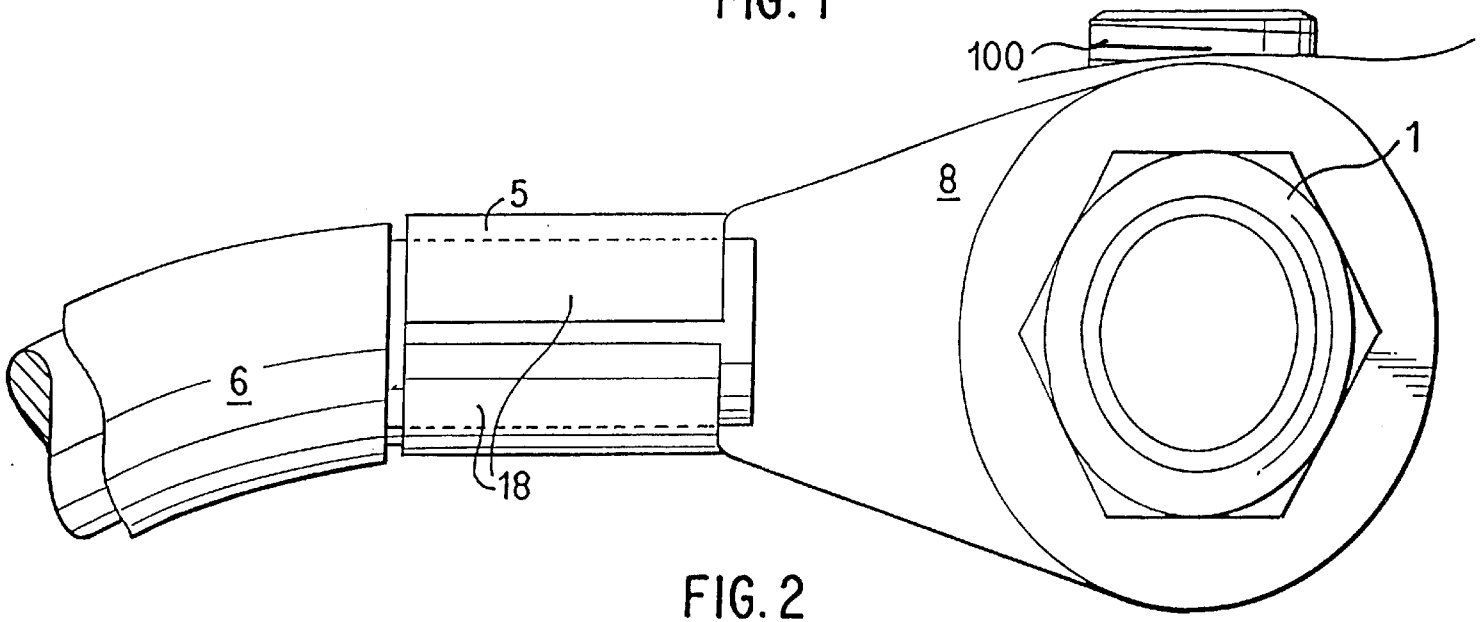
FIG. 2 is a plan view of the arrangement shown in FIG. 1.

FIG. 1 firstly shows a cable lug or terminal 5 which-as is generally known-is connected to the end of the cable 6, which has been stripped of insulation, by the clamping portion 18 of the cable lug being pressed to the cable. The contact plate 8 of the cable lug 5 extends away from the clamping portion 18, the clamping portion 18 and the cable 6 generally being disposed, as illustrated, above the underside 16 of the contact plate 8 which is to be brought into electrically conductive contact with the main member 100 or 101, for example the sheet metal of a motor vehicle body.

The nut 1 is rotatably but non-releasably connected to the contact plate 8 of the cable lug 5 by the nut 1, adjoining its normal end contact face 4 relative to the main member, having a mounting region 10 with an outside diameter that is greatly reduced relative to the outside diameter 21 and with a corresponding, downwardly directed shoulder 20 as a transitional portion, while provided in the mounting region 10 is a groove 11 which extends around the nut in an annular configuration.

Figure 5:
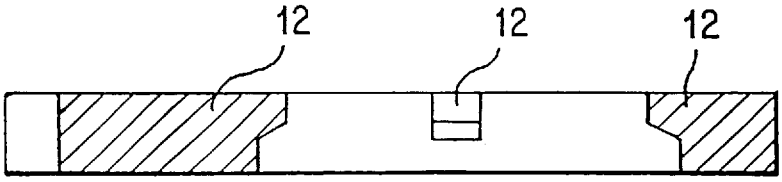
FIG. 5 is a side view of a cable lug similar to the cable lug of FIG. 1 but including plural projections.

The contact plate 8 is rotatably mounted with its bore 9 in the stepped configuration, on the greatly reduced outside diameter, in which respect it will be noted that the inside wall of the bore 9 is not of a cylindrical configuration but has a projection 12 extending in an annular configuration thereabout or has individual, radially inwardly projecting projections (see FIG. 5); the projection 12 or the individual projections engage into the groove 11 and, by virtue of the clearance provided, admittedly permit rotary movement as between the nut 1 and the contact plate 8, but do not permit separation thereof for example in the axial direction.

In that respect it is important that, in the assembled condition, the axial length of the mounting region 10 of the nut 1 with the greatly reduced outside diameter is less than the thickness of the contact plate 8 in that region. As a result of this, when the arrangement is in the assembled condition, that is to say when it is screwed to the main member, it is only the contact plate 8 that bears with its underside 16 against the corresponding co-operating side of the main member, but not the nut 1 with its contact end face 4, as otherwise that would not afford the necessary pressure on the part of the nut 1 by means of its shoulder 20 against the top side of the contact plate 8 and therewith also the necessary pressure between the underside 16 of the contact plate 8 and the main member 100.

Figure 3:
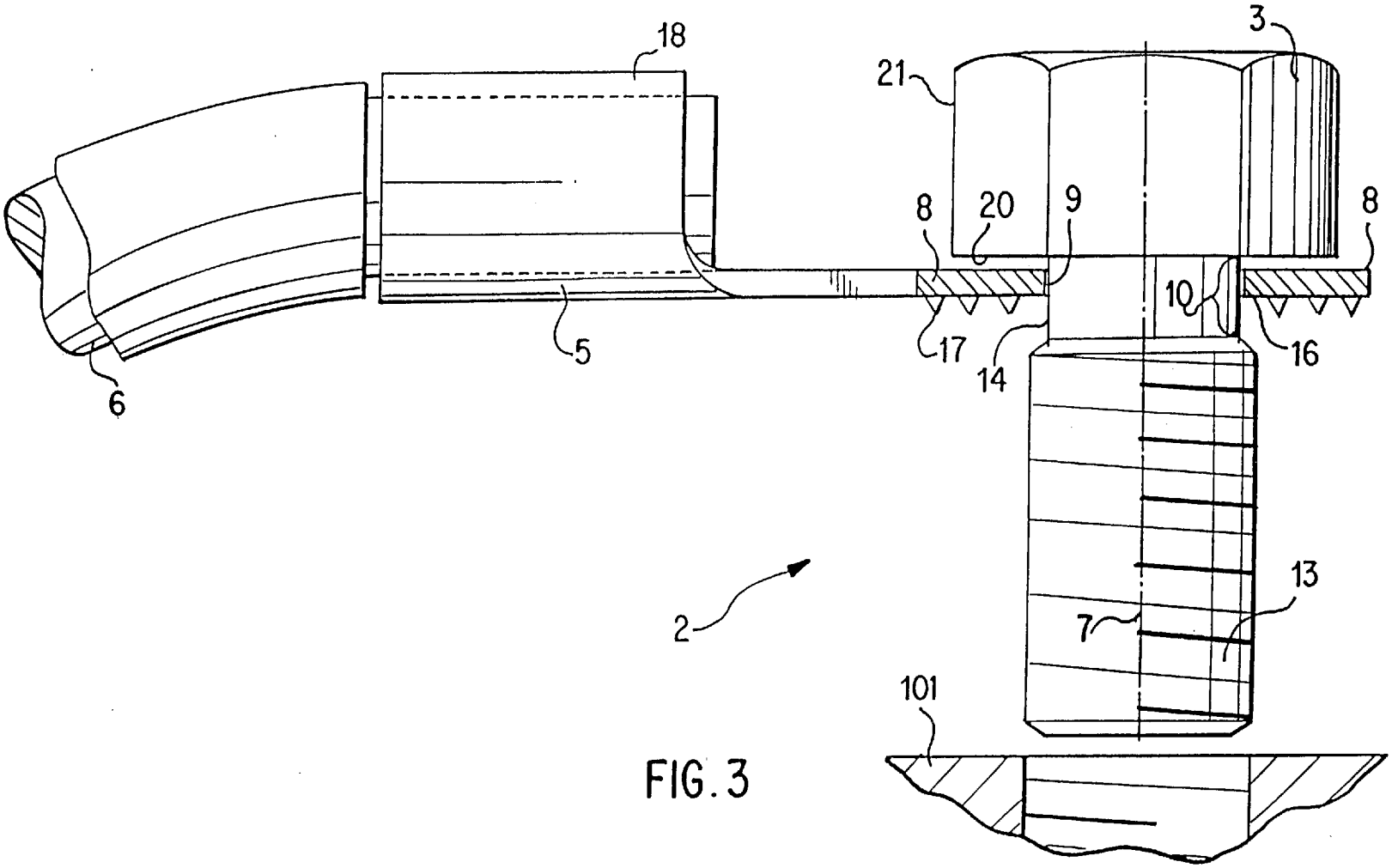
FIG. 3 is a side view of a screw with cable lug.

In comparison FIG. 3 shows the connection of a similar cable lug 5 with a screw 2, as is used when the main member does not have a fixed screwthreaded bolt or stud, but there is only a through bore with or without a female screwthread in the main member 101.

In this case, the contact plate 8 of the cable lug 5 with its bore 9 is mounted between the head 3 which is of larger diameter than the shank 14, and a thickened portion in the shank region.

That thickened portion is generally the screwthreaded region 13 which extends as far as the free end of the shank while disposed between the screwthreaded region 13 and the head 3 is a shank region 14 without an external screwthread and whose axial length at least corresponds to the thickness of the contact plate 8. If the diameter of the bore 9 in the contact plate 8 is admittedly larger than the outside diameter in the shank region 14 but smaller than the outside diameter in the screwthreaded region 13, the contact plate 8 can admittedly rotate freely about the longitudinal axis 7 of the screw 2, but it cannot be pulled off the screw 2.

The advantage in all these cases is that the operator using the arrangement only has to engage the screw or nut, for example by means of a screwing tool, and bring the screw or nut into position, but he does not additionally have to hold the cable lug as it is non-releasably connected to the nut 1 or the screw 2 respectively.

Further advantages are that the structural height of the solution according to the invention is very small and there is no need to use special forms of screws or nuts. The previous designs of commercially available screws or nuts can be employed. Furthermore, the cable lug is not weakened in terms of its transmission of current by virtue of the existence of bending tongues etc.

As FIG. 3 also shows, the underside 16 of the contact plate 8, preferably in the region of the shoulder 20 of the head 3 of the screw 2, may have individual or annular or radial projections 17 which are arranged to extend away downwardly in order to produce an intimate, reliably electrically conductive contact when that underside 16 of the contact plate 8 is pressed against the main member 101, even if that main member should already be painted.

Figure 4:
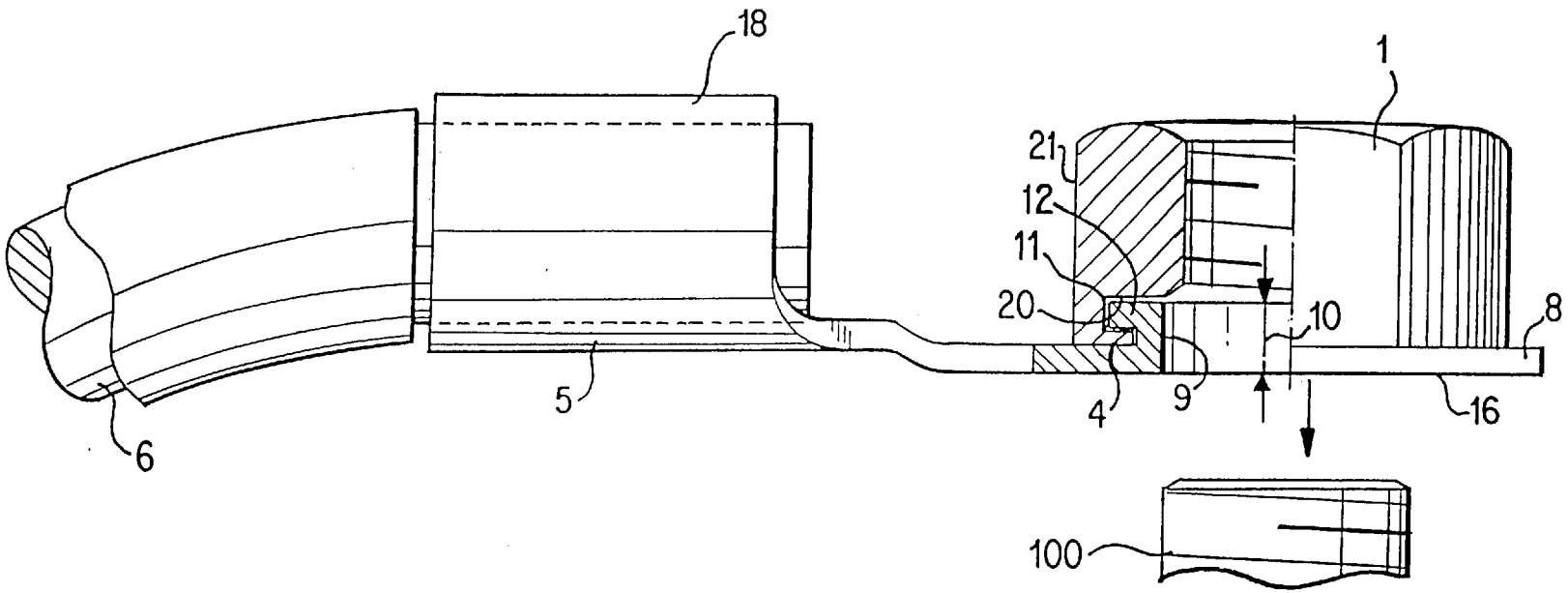
FIG. 4 shows a nut with another connection to the cable lug.

FIG. 4 shows another form of the connection of a nut 1 to the cable lug 5.

Figure 6:
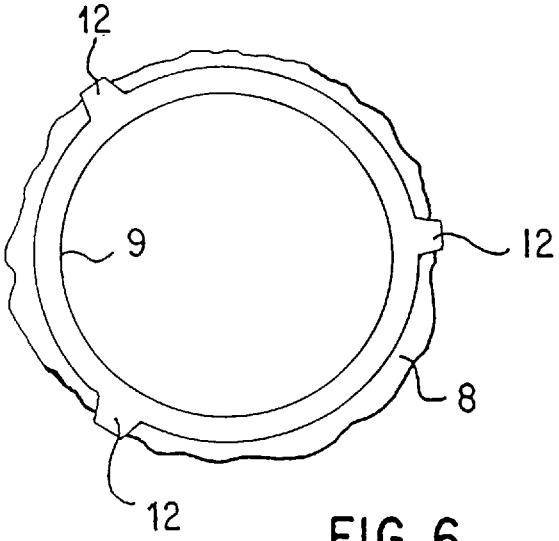
FIG. 6 is a top plan view of a cable lug similar to the cable lug of FIG. 4 but including plural projections.

In that arrangement, the peripherally extending groove 11 is not in the outside diameter but in the inside diameter of the nut 1, near the contact face 4 thereof. Accordingly radially outwardly projecting projections 12 (see FIG. 6) or a single annular peripherally extending projection 12 on the contact plate 8 of the cable lug extend into the groove 11. The projections 12-and likewise the groove 11 in the nut 1-may also be directed inclinedly outwardly upwardly.

The projections 12 are therefore no longer disposed in the plane of the contact plate 8 but above that plane. In addition the inside diameter of the bore 9 in the contact plate 8 of the cable lug 5 must be larger than the outside diameter of the internal screwthread in the nut 1 so that the screwthreaded pin or stud of the main member 100 can still be screwed into the nut 1.

The groove 11 in the inside diameter of the nut 1 is therefore disposed in a mounting region 10 which in the axial direction adjoins the contact end face 4 of the nut 1 and is of an inside diameter which is larger than the inside diameter of the internal screwthread in the nut 1.

What is claimed is:

1. In a fixing assembly including a contact plate attached to a cable and forming part of a cable lock and a nut rotatable relative to said contact plate, an improvement comprising:

a non-releasable connection between said nut and said contact plate for rotatable captivating said nut on said contact plate, said non-releasable connection including:

a downwardly facing shoulder defined on said nut and extending to a portion of said nut having an outer diameter which is substantially reduced in comparison with an outside diameter of the nut, said portion of said nut forming an outwardly opening circular groove; and at least one radial nose defined on the contact plate for engaging in said groove and rotatably captivating the nut so that an axial length of the portion of the nut is smaller than a thickness of the contact plate.

2. An improvement as defined by claim 1, wherein said nut defines an end face which is spaced from an underside of said contact plate.

3. An improvement as defined by claim 1, wherein said at least one radial nose is a single radially inwardly extending annular projection.

4. An improvement as defined by claim 1, wherein said at least one radial nose includes a plurality of individual radially inwardly extending projections.

5. In a fixing assembly including a contact plate attached to a cable and forming part of a cable lock and a nut rotatable relative to said contact plate and having an inner threads, an improvement comprising:

a non-releasable connection between said nut and said contact plate for rotatable captivating said nut on said contact plate, said non-releasable connection including:

at least one radial nose defined on the contact plate, engaging in an inner groove defined in said nut and extending radially outwardly, and rotatably captivating the nut, an inner diameter of the at least one nose being larger than an inner diameter of the inner thread of the nut, an axial length of the at least one nose being smaller than an axial width of the inner groove.

6. An improvement as defined by claim 5, wherein said nut defines an end face which engages a top side of said contact plate.

7. An improvement as defined by claim 5, wherein said at least one radial nose is a single peripherally extending annular projection.

8. An improvement as defined by claim 5, wherein said at least one radial nose includes a plurality of radially outwardly extending projections.

9. In a fixing assembly including a contact plate attached to a cable, forming part of a cable lock, and having a bore defined therein and a screw rotatable relative to said contact plate and having a head and a threaded shank, an improvement comprising:

a non-releasable connection between said screw and said contact plate for rotatably captivating said screw on said contact plate, said non-releasable connection including:

a reduced diameter cylindrical portion on the threaded shank adjacent to the head of the screw, the cylindrical portion having an axial length which is at least equal to a thickness of the contact plate and passing through the bore, the bore having a diameter which is smaller than a diameter of the threaded shank but larger than the reduced diameter cylindrical portion.

10. An improvement as defined by claim 9, wherein said reduced diameter cylindrical portion has an unthreaded outer surface.

11. An improvement as defined by claim 9, wherein said reduced diameter cylindrical portion has an axial length which is greater than the thickness of said contact plate.

12. An improvement as defined by claim 9, and further comprising projections disposed on an underside of said contact plate.

13. An improvement as defined by claim 12, wherein said projections are annular projections.

14. An improvement as defined by claim 12, wherein said projections are radial projections.

* * * * *